US005704651A

United States Patent [19]

Phillips

[11] Patent Number: 5,704,651

[45] Date of Patent: Jan. 6, 1998

[54] COUNTERFEIT RESISTANT DOCUMENTS AND METHODS

[75] Inventor: George K. Phillips, Paso Robles, Calif.

[73] Assignee: Verify First Technologies, Inc., Paso Robles, Calif.

[21] Appl. No.: 450,975

[22] Filed: May 25, 1995

[51] Int. Cl.[6] ..... B42D 15/00

[52] U.S. Cl. ..... 283/93; 283/91; 283/901; 283/902; 283/57; 283/58

[58] Field of Search ..... 283/93, 94, 901, 283/902, 57, 58, 59, 91

[56] References Cited

U.S. PATENT DOCUMENTS

| | | | |
|---|---|---|---|
| 1,998,237 | 4/1935 | Himmell . | |
| 3,282,720 | 11/1966 | Oleksiw | 283/93 X |
| 3,802,724 | 4/1974 | Gosnell | 283/58 X |
| 4,025,673 | 5/1977 | Reinnagel . | |
| 4,066,280 | 1/1978 | La Capria . | |
| 4,082,426 | 4/1978 | Brown . | |
| 4,151,666 | 5/1979 | Raphael et al. . | |
| 4,163,570 | 8/1979 | Greenaway . | |
| 4,168,088 | 9/1979 | Somlyody . | |
| 4,175,774 | 11/1979 | Tonges et al. . | |
| 4,175,776 | 11/1979 | Ranauro . | |
| 4,184,700 | 1/1980 | Greenaway . | |
| 4,227,719 | 10/1980 | McElligott et al. . | |
| 4,265,469 | 5/1981 | Mowry et al. . | |
| 4,303,307 | 12/1981 | Tureck . | |
| 4,307,899 | 12/1981 | Hoppe . | |
| 4,341,404 | 7/1982 | Mowry et al. . | |
| 4,351,547 | 9/1982 | Brooks, II . | |
| 4,455,039 | 6/1984 | Weitzen et al. | 283/58 X |
| 4,522,429 | 6/1985 | Gardner et al. . | |
| 4,534,398 | 8/1985 | Crane . | |
| 4,579,370 | 4/1986 | Corwin et al. | 283/93 X |
| 4,629,630 | 12/1986 | Devrient . | |
| 4,795,894 | 1/1989 | Sugimoto et al. | 235/468 |
| 4,867,481 | 9/1989 | Gundjian . | |
| 4,869,532 | 9/1989 | Abe et al. . | |
| 4,892,385 | 1/1990 | Webster, Jr. et al. . | |
| 4,988,126 | 1/1991 | Heckenkamp et al. . | |
| 5,029,901 | 7/1991 | Dotson et al. | 462/18 X |
| 5,044,707 | 9/1991 | Mallik | 283/93 X |
| 5,093,184 | 3/1992 | Edwards . | |
| 5,137,304 | 8/1992 | Silverschotz . | |
| 5,149,140 | 9/1992 | Mowry, Jr. et al. | 283/902 X |
| 5,190,318 | 3/1993 | Mantegazza | 283/58 X |
| 5,197,765 | 3/1993 | Mowry, Jr et al. | 283/93 |
| 5,271,645 | 12/1993 | Wicker . | |
| 5,344,192 | 9/1994 | Phillips | 283/57 X |
| 5,454,598 | 10/1995 | Wicker . | |

OTHER PUBLICATIONS

McGarry, Dennis, "Document Security", *Technical Update–National Business Forms Association* by Dennis McGarry, Dec. 1, 1990, p. 3.

"Watermarked and Non–Impact Papters", *Technical Report–National Business Forms Association*, Aug. 17, 1987, vol. 1, No. 8, T.U. #32 (LLB), pp. 1–4.

"Making It Easy for People to Be Honest–Three Steps to Document Security", *Standard Register*, Form No. 5463 4.89–1, 1990, pp. 1–6.

McLoone, Sharon, "Inks That Are Mightier Than the Counterfeiter", *Form*, May 1995, p. 88, 90, 93.

Steven S. Scaman et al., "Security Indicator Inks Gain Market Prominence", *Flexo*, Dec. 1994, pp. 14, 16–17.

*Primary Examiner*—Frances Han
*Attorney, Agent, or Firm*—Lyon & Lyon LLP

[57] ABSTRACT

An original document includes alphanumeric characters defined by an overprinted reflective layer formed on a complex patterned region, and having graphic or font size, shape and type coordinated to the particular patterns in the patterned region. The coordination of the overprinted reflective layer with the patterned region is such that if the document is electronically scanned or duplicated by xerographic photocopying, the pattern will at least partially obscure the alphanumeric characters so that they can only be read with difficulty, thereby camouflaging the text.

15 Claims, 2 Drawing Sheets

COUNTERFEIT RESISTANT DOCUMENTS AND METHODS

BACKGROUND OF THE INVENTION

The field of the invention pertains to the prevention of duplicating or counterfeiting of valuable documents. In particular, the field of the present invention pertains to methods for printing valuable documents and the resultant documents so that the original document is readily discernable from a copy or reproduction of the document.

Presently known approaches have generally sought to prevent duplication or counterfeiting of documents by electronic scanning or xerographic photocopier by printing information on the document in specially designed inks or materials so that the information can be viewed on the original, but due to the unique color, texture, or reflective properties of the material, will be readily discernable from a copy which lacks these materials.

For example, U.S. Pat. No. 4,066,280 to LaCapria describes a document upon which is printed a specularly reflective coloring material such as powdered aluminum, which is not accurately reproduced by color copiers. The duplicate image will appear in different colors than on the original.

Similarly, U.S. Pat. No. 4,988,126 to Heckenkamp et al. describes an original document having surface relief in the form of embossed characters. A luminescent substance is formed into raised or depressed areas of the surface relief. The reflective properties of the surface relief render the original readily discernable from a photocopy which lacks the surface relief.

U.S. Pat. No. 4,082,426 describes retroreflective sheet materials formed of a monolayer of microsphere-lenses overlaying a specularly reflective layer coated over a polymeric material. A transparent image layer of varying thickness permits light rays to be transmitted to and reflected by the specularly reflective layer behind the image layer. The varying thickness of the image layer and the spacing between the specularly reflective layer and the microsphere-lenses changes the reflective characteristics of the sheeting, so that markings on the sheet are visible only from certain angles under retroreflective viewing conditions.

U.S. Pat. No. 4,892,385 to Webster, Jr. et al. describes an authenticating device which can be bonded to the surface of a document to identify an original document.

Another approach has been to provide specially manufactured copy-resistant paper upon which information of any kind can be printed using conventional processes and inks. An example U.S. Pat. No. 4,867,481 to Gundjian describes copy-resistant paper having a two-color grid-like pattern printed over its surface, with each color having the same spectral profile but different spectral response. U.S. Pat. No. 4,303,307 to Tureck et al. describes a paper substrate coated with specially sized and spaced beads which break up incident light emitted by a photocopier. U.S. Pat. No. 5,093,184 to Edwards describes security paper having elongated metallic elements embedded in the paper.

Yet another approach has been to provide specially designed inks or other printing materials having different or unique color or reflective properties. For example, U.S. Pat. No. 5,271,645 to Wicker describes a color-copier resistant pigment consisting of print stuff mixtures obtained by mixing commercially available pigments with fluorescence compound.

U.S. Pat. No. 4,869,532 to Abe et al. describes a print produced by printing or coating an infrared reflective coloring agent and another printing ink containing an infrared absorptive coloring agent in combination on a base material, to produce visually-recognizable information along with other information recognizable with the aid of infrared lighting.

U.S. Pat. No. 4,025,673 and U.S. Pat. No. 3,887,742 to Reinnagel describe prevention of photocopying by selection of different color or color filter combinations for the text and background.

U.S. Pat. No. 4,175,776 to Ranauro describes a document in which the text and background are characterized by different optical reflectivities for incident visible light and which are substantially non-absorbing with respect to incident light having wavelengths within the response spectrum of color xerographic copying machines. When the document is photocopied, the incident light of the photocopier produces a uniform reflected pattern over the indicia which causes the indicia to "drop out" of the copy.

U.S. Pat. No. 4,522,429 to Gardner et al. discloses a document upon which text is printed upon colored paper having a reflection spectral response of less than about ten percent for light of below 600 millimicron wavelength, so that the color is sufficiently contrasting with the text to be visible when viewed under white light, but cannot be successfully photocopied.

SUMMARY OF THE INVENTION

The present invention provides an advantageous approach to the prevention of duplication or counterfeiting by providing a variety of specially configured camouflage background patterns printed on the document surface and formed of randomly selected alphanumeric or kanji characters, or woven patterns. An overprinted image having different reflective characteristics than the background pattern and having graphics, font size and type particularly selected to coordinate with the camouflage background pattern is overprinted on at least a portion of the camouflage background pattern. The coordination of the background pattern and the overprinted image renders the overprinted image difficult to read unless a special reading device is utilized or the document is viewed at an angle with respect to incident light to cause a reflection off of the overprinted image. This overprinted image or message can be printed or produced with special inks, metallic foils or other materials that can be visually recognized or ascertained from the background indica but will not be readily present in a scanned or photocopied image. Copied images, therefore, will be obscured by the camouflage background pattern.

BRIEF DESCRIPTION OF THE DRAWING FIGURES

DETAILED DESCRIPTION OF THE PREFERRED EMBODIMENT

Figure 1:
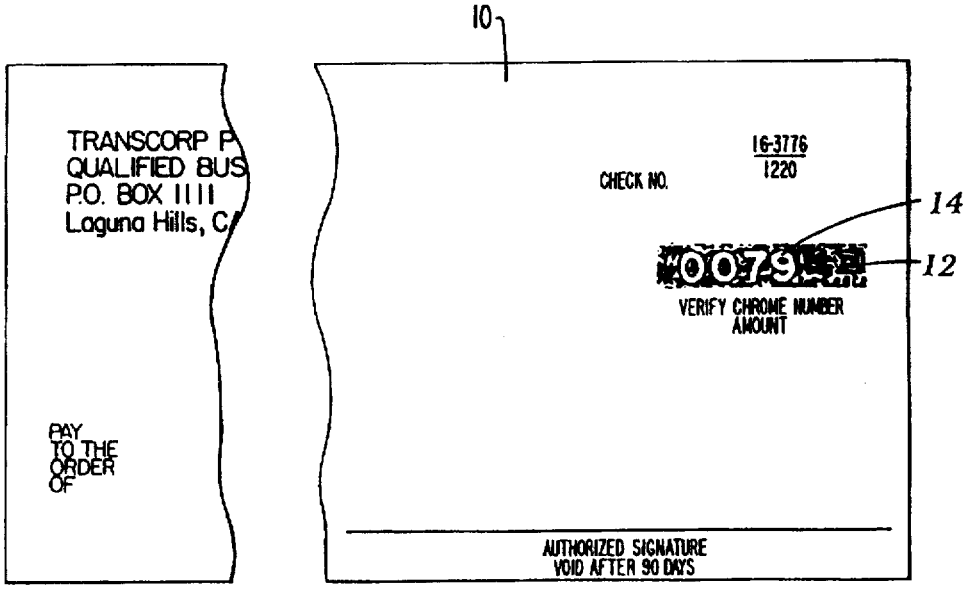
FIG. 1 shows a portion of a check upon which indicia have been printed in accordance with the present invention.

FIG. 1 shows a document including a substrate 10. The substrate 10 is preferably of paper stock; however, any suitable substrate may be used without departing from the scope of the present invention. It is anticipated that the present invention will be particularly suitable for checks and other documents of value, although the present invention is not limited to these applications and can be used in any application in which prevention of electronic scanning or photocopying is desirable. For illustrative purposes, FIG. 1 depicts the present invention used on a check.

Figure 2:
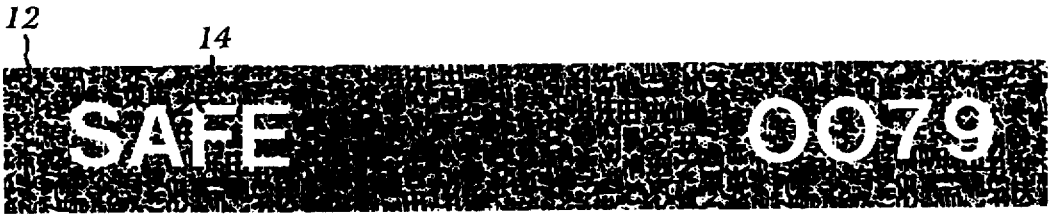
FIGS. 2–7 depict various complex background patterns which can be used with the present invention.
Figure 3:
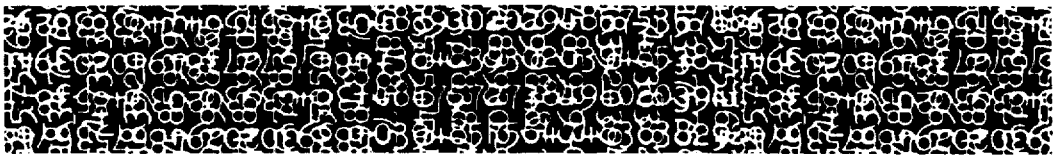
Figure 4:
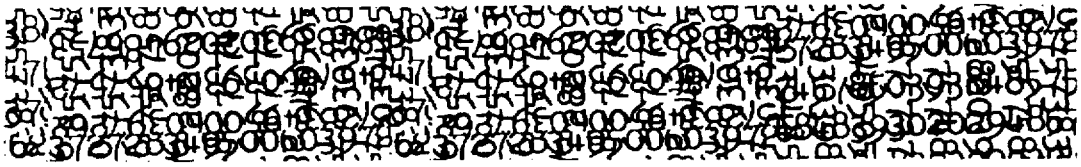
Figure 5:
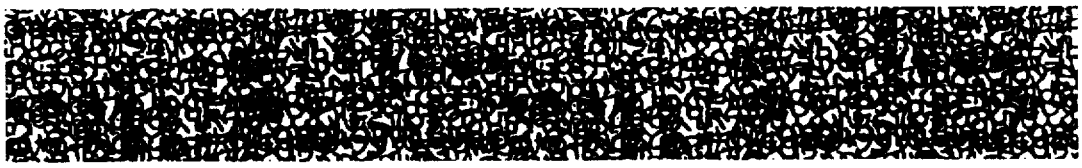
Figure 6:
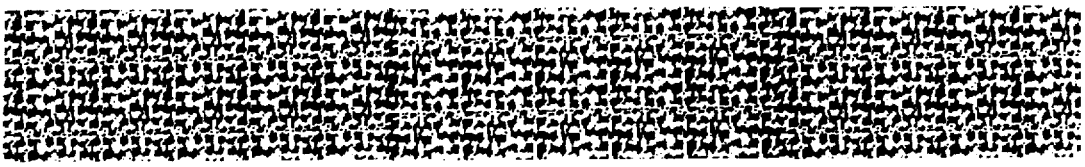
Figure 7:
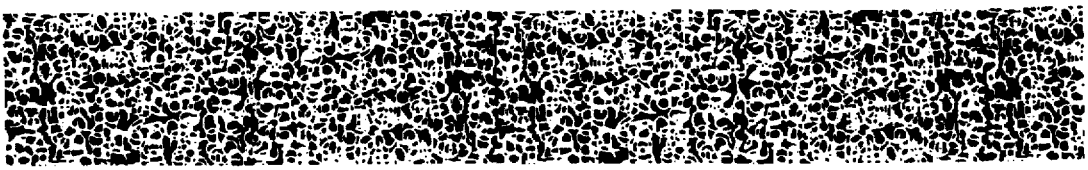

A patterned background 12 is imprinted upon at least a portion of the substrate surface. In FIG. 1, this patterned background 12 is printed in the upper right of the face of the check, over the portion of the check on which the amount of the check would normally be printed. However, the patterned background may be printed on any location of the substrate surface upon which the overprint indicia is desired to be printed. Preferably, the patterned background 12 comprises a complex asymmetrical pattern of alternating black-and-white areas. Several patterns, illustrated in FIGS. 2–7, are particularly preferred. FIG. 2 shows an example of a patterned background formed by randomly selected overlapping kanji characters; FIG. 3 shows an example of a patterned background formed by randomly selected overlapping white numeric characters printed on a black background; FIG. 4 shows an example of a patterned background formed by randomly selected overlapping black numeric characters printed on a white background; FIG. 5 shows an example of a densely packed or closely packed numeric background formed by printing a high concentration of overlapping dark numeric characters on a white background; FIG. 6 shows an example of a patterned background formed of a woven pattern; and FIG. 7 shows an example of a densely packed or closely packed numeric background formed by printing a high concentration of overlapping white numeric characters on a black background.

The patterns used in a particular application need not be limited to black-and-white areas; any combination of colors can be used. Further, the patterns need not be limited to those specifically depicted; complex patterns, such as overlapping random alpha characters or other complex graphics or symbols, can be used so long as the elements forming the pattern are sufficiently sized and detailed so as to make the graphics or characters printed or produced thereon blend and be somewhat difficult to ascertain.

In some applications it may be desired to combine several different patterns to form a single background. Alternatively, several different background patterns may be printed on different portions of the substrate surface, each adapted for printing of different sets or types of indicia thereon. Several patterned areas may even be printed in adjacent areas on the substrate surface, so that consecutive lines of text are printed on different backgrounds.

The overprint indicia 14 can be overprinted or produced upon the patterned area as a metallic image, preferably of gold, silver or chrome. The overprint indicia 14 can also be made up of other print substances such as metallic, magnetic or thermochromic inks. The overprint indicia 14 may be applied to the substrate by any number of suitable methods, such as hot stamping where the indicia comprises a layer of chrome foil or another metallic foil substance. The overprint indicia may be printed in an open font, a closed font, or in other font or graphics appropriate for the particular camouflage application for which the present invention is desired to be used. In general, the overprinting using reflective material upon the complex patterned background renders the indicia difficult to view on the original except when viewed obliquely at an angle relative to the substrate, such that incident light is reflected off the overprint indicia at an angle. The reflection of incident light off of the reflective printing generally results in the indicia being most visible when the angle of viewing is approximately equal to and opposite the angle of incidence. When the overprint indicia is produced to create a reflective image, the reflective property normally permits it to be copied as a black image by electronic scanning or by xerographic photocopying rendering the overprint image on a copy virtually unreadable at any angle as opposed to the way it appears on the original.

In a preferred embodiment, the size of the graphics or text of the overprinted indicia are selected to correspond to the size of the patterns in the complex patterned background, in order to provide maximum camouflaging of the overprinted image on both the original and any copies. For example, if the background selected is that of overlapping numeric characters as shown in FIGS. 3, 4, 5, or 7, the overprint indicia font, graphics and design is preferably selected so that the text is approximately the same size and general design as the numerals used to form the background pattern.

In addition to size, certain types of background patterns are particularly suitable for certain overprint indicia font types. For example, it has been observed that overprint indicia printed or produced in an open font upon a woven background as shown in FIG. 6 provides particularly good camouflage. Moreover, the background pattern may be of varying rather than uniform darkness or complexity, such that the portions of the patterned background are especially complex or dark (or light, where the pattern is one of dark characters printed on a white background) in the areas upon which important indicia are to be overprinted or otherwise produced.

It has also been observed that printing of an overprint indicia having reflective properties with certain types of surface textures provides particularly suitable camouflage when used in combination with certain font types and background patterns. For example, a reflective overprint indicia may be applied to the substrate surface such that the reflective or metallic layer is uniform and smooth, or it may be of an uneven texture. The particular texture or form of printing or stamping selected may be varied depending upon the background pattern selected, the degree of protection desired and the particular application.

In another embodiment of the present invention, a warning legend or identifier may also be imprinted upon the substrate 10 to advise readers of the document that the original document includes a camouflaged overprint indicia or message. This legend may read "Verify chrome number amount", or similar warning legend which advises the reader to look for the reflective or overprinted indicia. Other possible legends may include "Original must have metallic chrome" or "Void without metallic chrome". Preferably, this legend is located on the substrate 10 adjacent or very near to the overprint indicia 14.

In use, an original document configured according to the present invention will include indicia 14 formed as a special overprint or metallic layer over the patterned area 12. The patterned background serves to camouflage the indicia making the indicia difficult to read when the document is viewed at an angle perpendicular to its surface. However, when the document is viewed obliquely such that incident light reflects off of the overprint indicia at an acute angle relative to the document surface, the reflected light acts to increase the contrast between the overprint indicia and the background pattern such that the indicia may be more easily read.

If an original document including a reflective or metallic overprint indicia is copied, as by computer or electronic scanning or color xerographic photocopying, the copies will not include this reflective or metallic indicia. Since modern scanners and color copiers generally produce duplicate images by focusing a light on the surface of the original and performing a color analysis of the light absorbed by various parts of the original, they do not accurately reproduce true colors when specular reflections are produced from the surface of the original. Instead, the overprint indicia 14 will be reproduced on the duplicate in ink (or toner) of a color different than the color of the reflective material or metal on the original, and the duplicate image of the indicia will be partially obscured or hidden by the complex patterned background 12, so that the indicia 14 can only be read with difficulty, if at all. Thus, the indicia on the duplicate will be at least partially camouflaged.

In some applications, it may be desirable to completely obscure the overprint indicia on a copy by providing a more complex pattern or overprinting the overprint indicia in a similar colored ink (as described in U.S. patent application Ser. No. 08/291,873, which is hereby incorporated herein in its entirety by reference) so that the indicia cannot be read after being copied or scanned; however, for other applications, the overprint indicia need only be partially obscured so that reading is made more difficult on the copy. In the latter case, when a person such as a bank teller is confronted with a duplicate or copy, the obscuring of the indicia due to copying will require the teller to pause and look carefully at the obscured text. When he or she does so, the legend printed on the check will inform him that a check which does not include for example, a reflective image, is not an original. Because the partial obscuring of the copied indicia by the photocopied patterned area forces viewers to look very carefully at the document, viewers such as bank tellers are prevented from absently glancing at a copied document and, by failing to see the legend or read all of the fine print on the document, carelessly processing it as an original.

In yet another alternative embodiment of the present invention, a second patterned area may also be disposed on the substrate surface upon which is overprinted in metallic print the word "SAFE". The word "ORIGINAL", or any other appropriate designation, may also be used for this purpose. The addition of this second patterned area and indicia provides further protection against counterfeiting by providing a second area on the substrate surface having an overprint indicia. Further, the patterned area underlying the word "SAFE" may be made even more complex than that used for the other indicia, so that, when the document is duplicated by photocopying, the word "SAFE" is virtually completely obscured by the pattern in the copy. A second legend may also be printed on the substrate to inform viewers to look for the word "SAFE" upon the face of the document.

Although this particular invention has been described in detail with particular reference to the preferred embodiment as illustrated and described herein, various modifications may be made to it by one skilled in the art which will fall within the scope and spirit of the present invention as set forth in the appended claims.

I claim:

1. A counterfeit-resistant document, comprising:

a substrate having a first printable surface;

a camouflage background pattern printed on at least a portion of said first printable surface of said substrate; and an image on said first printable surface, said image overprinted on said camouflage background pattern, said image having different reflective characteristics than said camouflage background pattern, wherein said camouflage background pattern obscures said image at viewing angles employed by photocopy devices.

2. The document of claim 1, wherein said camouflage background pattern is a complex asymmetrical pattern.

3. The document of claim 2, wherein the camouflage background pattern comprises portions colored in black alternating with white portions.

4. The document of claim 1, wherein said camouflage background pattern comprises randomly selected, overlapping kanji characters.

5. The document of claim 1, wherein said camouflage background pattern comprises randomly selected, overlapping numeric characters.

6. The document of claim 1, wherein said camouflage background pattern comprises alternating light and dark portions in a woven pattern.

7. The document of claim 1, wherein said image is formed to define alphanumeric characters.

8. The document of claim 7, wherein the image defines alphanumeric characters printed in an open font.

9. The document of claim 7, wherein the image defines alphanumeric characters printed in a closed font.

10. The document of claim 7, wherein the size of the alphanumeric characters is selected to correspond to the camouflage background pattern.

11. The document of claim 1, wherein said image has reflective properties different than said reflective properties of said camouflage background pattern.

12. The document of claim 1, wherein said image is formed of chrome.

13. A method of printing a counterfeit-resistant image on a substrate surface, comprising the steps of:

printing a camouflage background pattern on a portion of a first printable surface of a substrate; and overprinting an image on said camouflage background pattern, said image having different reflective characteristics than said camouflage background pattern, said image may be printed on said camouflage background pattern in one of a variety of fonts or styles slected to correspond to said camouflage background pattern, the dimensions of said image are coordinated with said camouflage background pattern so that when said substrate is electronically scanned, the scanned image of said image is at least partially obscured by the scanned image of said camouflage background pattern.

14. The method of claim 13 wherein said camouflage background pattern consists of random, overlapping light-and-dark portions.

15. The method of claim 14 wherein the light-and-dark portions are formed of randomly selected alphanumeric or kanji characters.

* * * * *